US007464787B2

(12) United States Patent
Davis, Jr.

(10) Patent No.: US 7,464,787 B2
(45) Date of Patent: Dec. 16, 2008

(54) MOTORCYCLE EXHAUST ASSEMBLY AND METHOD OF USING SAME

(76) Inventor: Roger George Lee Davis, Jr., 12925 Brookprinter Pl., Suite 400, Poway, CA (US) 92064

( * ) Notice: Subject to any disclaimer, the term of this patent is extended or adjusted under 35 U.S.C. 154(b) by 0 days.

(21) Appl. No.: 11/672,846

(22) Filed: Feb. 8, 2007

(65) Prior Publication Data

US 2008/0121456 A1 May 29, 2008

Related U.S. Application Data

(60) Provisional application No. 60/826,692, filed on Sep. 22, 2006.

(51) Int. Cl.
*F01N 7/08* (2006.01)
*F01N 1/00* (2006.01)
*F01N 1/02* (2006.01)
*F01N 7/18* (2006.01)

(52) U.S. Cl. ..... 181/227; 181/249; 181/255; 181/282

(58) Field of Classification Search ..... 181/227, 181/249, 255, 282
See application file for complete search history.

(56) References Cited

U.S. PATENT DOCUMENTS 2,025,271 A * 12/1935 Compo ..... 285/189
2,308,607 A * 1/1943 Jackson ..... 285/55
2,732,026 A * 1/1956 Folts ..... 181/243
3,200,902 A * 8/1965 Jones ..... 181/243
4,475,623 A * 10/1984 Gerber et al. ..... 181/243
4,537,278 A * 8/1985 Okada et al. ..... 181/227
4,756,383 A * 7/1988 Sterrett ..... 181/243
5,831,223 A * 11/1998 Kesselring ..... 181/227
6,006,859 A * 12/1999 Hussaini ..... 181/227
6,367,580 B1 * 4/2002 Chang ..... 181/241
6,431,311 B1 * 8/2002 Brown et al. ..... 181/282
6,470,998 B1 * 10/2002 White ..... 181/243
6,546,722 B2 * 4/2003 Sagara et al. ..... 60/324
6,715,581 B2 * 4/2004 Dooley ..... 181/228
D490,036 S * 5/2004 Cho ..... D12/194
6,935,461 B2 * 8/2005 Marocco ..... 181/270
7,007,720 B1 * 3/2006 Chase et al. ..... 138/110
D520,925 S * 5/2006 Savage et al. ..... D12/194
7,152,710 B1 * 12/2006 Huang et al. ..... 181/227
7,240,767 B2 * 7/2007 Nakagawa ..... 181/227
7,281,606 B2 * 10/2007 Marocco ..... 181/270
2002/0166719 A1 * 11/2002 Dooley ..... 181/228
2004/0050618 A1 * 3/2004 Marocco ..... 181/248
2004/0069562 A1 * 4/2004 Kondo et al. ..... 181/227
2004/0206573 A1 * 10/2004 Hsu ..... 181/228
2004/0238273 A1 * 12/2004 Fritskey et al. ..... 181/264
2005/0082113 A1 * 4/2005 Okunosono ..... 181/227
2005/0103565 A1 * 5/2005 Nakagawa ..... 181/227
2005/0139417 A1 * 6/2005 Quast ..... 181/227
2005/0161283 A1 * 7/2005 Emler ..... 181/249

(Continued)

*Primary Examiner*—Walter Benson
*Assistant Examiner*—Christina Russell
(74) *Attorney, Agent, or Firm*—Stephen C. Beuerle; Procopio Cory Hargreaves & Savitch LLP

(57) ABSTRACT

A configurable motorcycle exhaust assembly, including an elongated hollow body; an inlet end cap fixedly connected to an inlet end of the elongated hollow body; an exhaust end mount fixedly connected to an exit end of the elongated hollow body; and an exhaust end cap removably attached to the exhaust end mount.

5 Claims, 4 Drawing Sheets

U.S. PATENT DOCUMENTS

2005/0167191 A1* 8/2005 Miller ..... 181/227
2006/0037811 A1* 2/2006 Kensok et al. ..... 181/249
2007/0181362 A1* 8/2007 Champney et al. ..... 181/227
2007/0246292 A1* 10/2007 Sichau ..... 181/241

* cited by examiner

MOTORCYCLE EXHAUST ASSEMBLY AND METHOD OF USING SAME

CROSS REFERENCE TO RELATED APPLICATIONS

This application claims the benefit of prior U.S. Provisional Patent Application No. 60/826,692 filed Sep. 22, 2006 under 35 U.S.C. 119(e).

TECHNICAL FIELD

The present invention generally relates to motorcycle exhaust assemblies, and more particularly to configurable motorcycle exhaust assemblies.

BACKGROUND

Motorcycle owners often wish to alter the characteristics of their motorcycles. The inventor has recognized a need for a motorcycle exhaust assembly and method of use that allows quick, easy, and inexpensive interchangeability of components.

SUMMARY

Accordingly, embodiments of the present invention provide for a configurable motorcycle exhaust assembly that enables a user to easily remove and replace an exhaust end cap with other interchangeable exhaust end caps.

In one aspect of the invention, a configurable motorcycle exhaust assembly includes: an elongated hollow body; an inlet end cap fixedly connected to an inlet end of the elongated hollow body; an exhaust end mount fixedly connected to an exit end of the elongated hollow body; and an exhaust end cap removably attached to the exhaust end mount. An implementation of the foregoing includes multiple, interchangeable exhaust end caps.

A further aspect of the invention provides for a method of using a configurable motorcycle exhaust assembly, including: attaching a first exhaust end cap to an exhaust end mount; removing the first exhaust end cap from the exhaust end mount; and attaching a second, different exhaust end cap to the exhaust end mount.

Other features and advantages of the present invention will become more readily apparent to those of ordinary skill in the art after reviewing the following detailed description and accompanying drawings.

DETAILED DESCRIPTION

Certain embodiments as disclosed herein provide for a configurable motorcycle exhaust assembly and methods of using the configurable motorcycle exhaust assembly.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figures 1A, 1B, 1C, 1D:
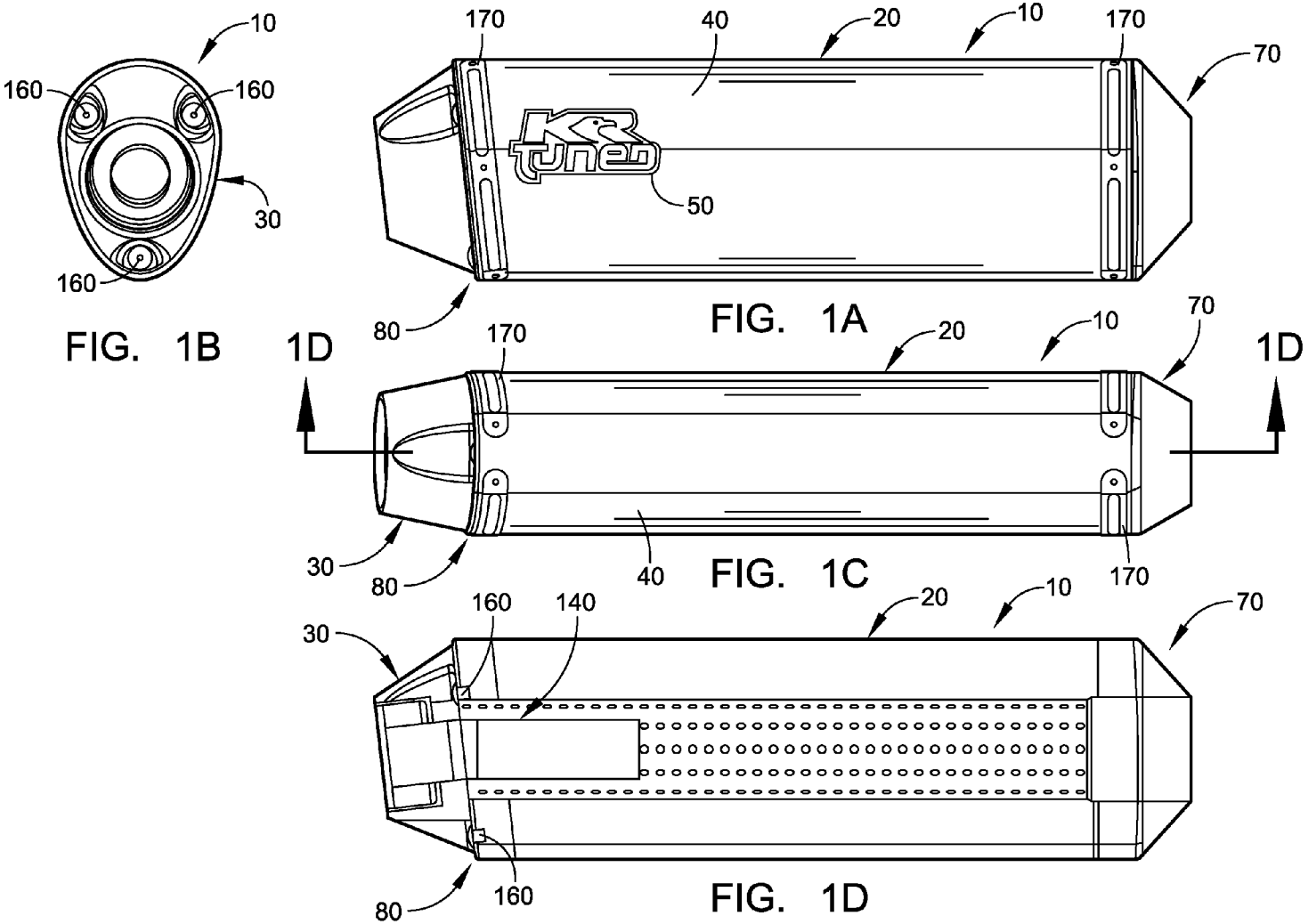
FIG. 1A is a front elevational view of an embodiment of the configurable motorcycle exhaust assembly.
FIG. 1B is a left side elevational view of the configurable motorcycle exhaust assembly of FIG. 1A and shows an embodiment of a removable/interchangeable exhaust end cap.
FIG. 1C is a bottom plan view of the configurable motorcycle exhaust assembly of FIG. 1A.
FIG. 1D is a cross-sectional view of the configurable motorcycle exhaust assembly of FIG. 1A taken along line 1D-1D of FIG. 1C.

With reference to FIGS. 1A-D, an embodiment of a configurable motorcycle exhaust assembly 10 includes an exhaust canister 20, a removable/interchangeable exhaust end cap 30, a baffle 140, an exhaust end mount 80, and an inlet end cap 70. Also included are fasteners 160, as shown in FIGS. 1B and 1D.

The exhaust canister 20 includes an elongated hollow body 40 ("body") made from a hard rigid material such as, but not limited to, carbon fiber, steel, or titanium. The body 40 is generally tubular, and, in an alternative embodiment, a variety of different cross-sectional shapes and/or configurations are provided, such as different dimensions, aspect ratios, longitudinal cross-sectional shapes, and colors. As shown in FIGS. 1A-C, an inlet end cap 70 is welded or fixedly connected to the exhaust canister 20 at the inlet end of the body 40. Like the body 40, the inlet end cap 70 is made from a hard, rigid material such as, but not limited to, carbon fiber, steel, or titanium. Where either or both of the body 40 and the inlet end cap 70 are made of a material not amenable to welding, such as carbon fiber, rivets can be used to fixedly connect the inlet end cap 70 to the body 40. In one embodiment, for example, a band-rivet system 170 is used to connect the inlet end cap 70 to the body 40. The inlet end cap 70 generally has the same cross-sectional shape as the body 40. A logo detail 50 may be optionally disposed on the body 40.

The exhaust canister 20 further includes an exhaust end mount 80 welded or fixedly connected to the exhaust end of the body 40. Like the inlet end cap 70, the exhaust end mount 80 is made from a hard, rigid material such as, but not limited to, carbon fiber, steel, or titanium. Where either or both of the body 40 and the exhaust end mount 80 are made of a material not amenable to welding, such as carbon fiber, rivets can be used to fixedly connect the exhaust end mount 80 to the body 40. In one embodiment, for example, a band-rivet system 170 is used to connect the exhaust end mount 80 to the body 40. The exhaust end mount 80 generally has the same cross-sectional shape as the body 40.

Also shown in FIGS. 1-3 is a removable, interchangeable exhaust end cap 30. The exhaust end cap 30 is removably attached to the exhaust end mount 80. Like the body 40, the exhaust end cap 30 is made from a hard rigid material such as, but not limited to, carbon fiber, steel, or titanium, and generally has the same cross-sectional shape as the exhaust end mount 80 and the body 40. The exhaust end cap 30 is easily removable for interchangeability with another different exhaust end cap. Fasteners 160 are provided to facilitate convenient removal and replacement. Typically, the fasteners 160 are threaded fasteners, such as screws or bolts, though it will be appreciated that other types of fasteners may be used.

FIG. 1B is a left side elevational view of the configurable motorcycle exhaust assembly of FIG. 1A, and shows an embodiment of a removable, interchangeable exhaust end cap 30. The example illustrated includes three recessed sections as shown in the rear view illustrated, each recessed section having a hole through which a fastener 160 is inserted to removably connect the exhaust end cap 30 to an exhaust end mount 80. FIG. 1B further depicts the exhaust end cap 30 having a substantially egg-shaped cross-section, in accordance with one embodiment. Further detailed views of the exhaust end cap 30 are provided in FIGS. 3A-D. In an alternative embodiment, the exhaust end cap 30 includes alternative configurations.

As illustrated in FIG. 1D, a baffle 140 is carried within the exhaust canister 20.

Figure 2A:
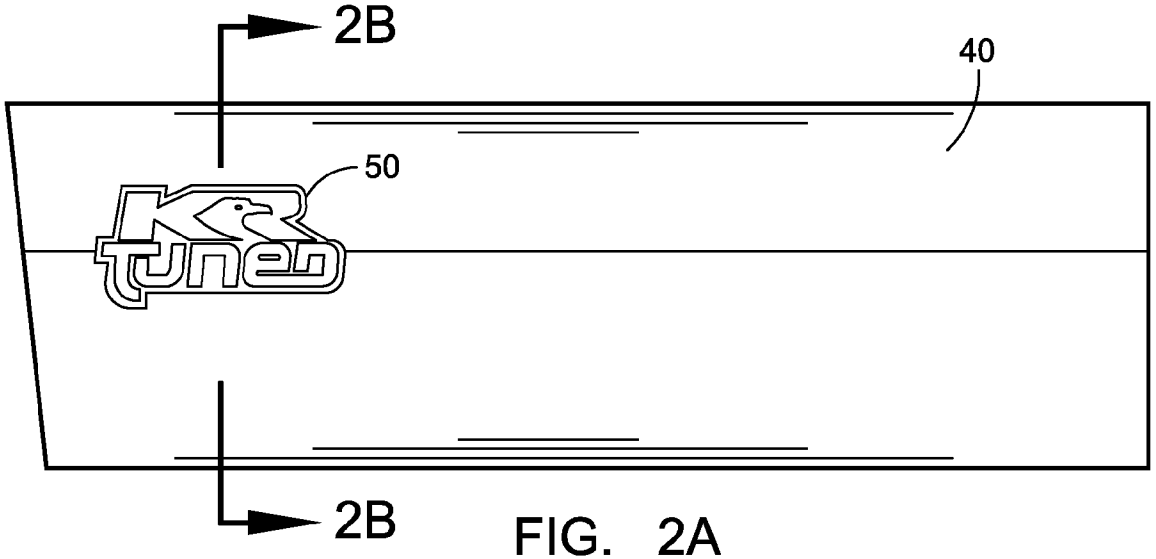
FIG. 2A is a partial side elevational view of the exhaust canister of the configurable motorcycle exhaust assembly of FIG. 1A.
Figure 2C:
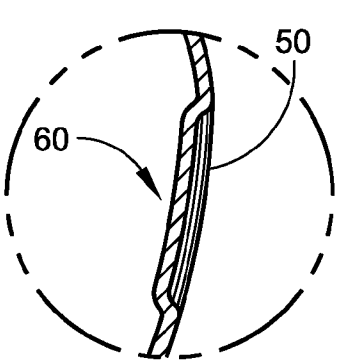
FIG. 2C is a detailed view of the exhaust canister taken along area 2C of FIG. 2B.
Figure 2B:
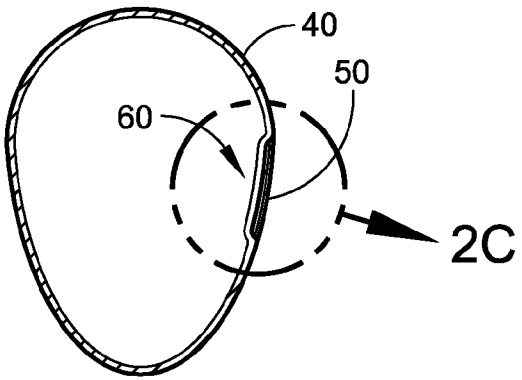
FIG. 2B is a cross-sectional view of the exhaust canister taken along line 2B-2B of FIG. 2A.
Figure 3B:
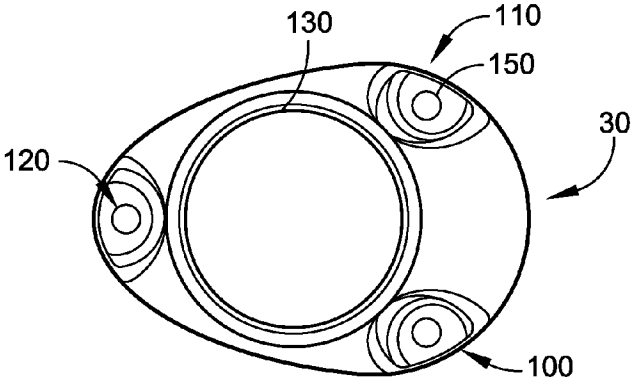
FIG. 3B is left side elevational view of the removable/interchangeable exhaust end cap illustrated in FIG. 3A.
Figure 3A:
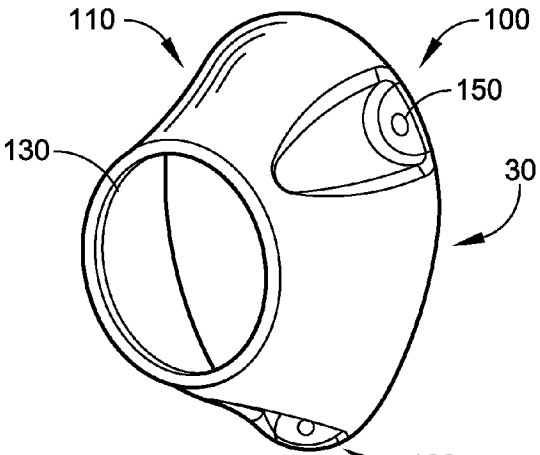
FIG. 3A is perspective view of the removable/interchangeable exhaust end cap illustrated in FIGS. 1A-1D.
Figure 3C:
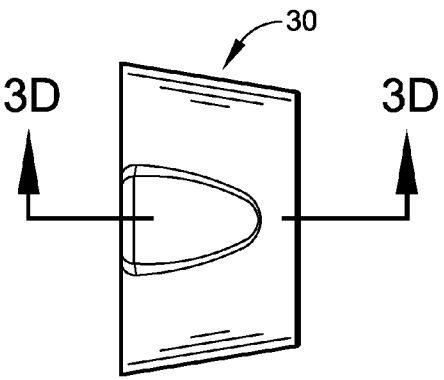
FIG. 3C is bottom plan view of the removable/interchangeable exhaust end cap illustrated in FIG. 3A.
Figure 3D:
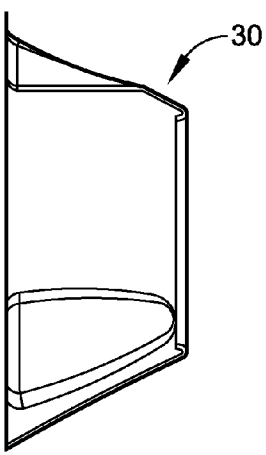
FIG. 3D is cross-sectional view of the removable/interchangeable exhaust end cap taken along line 3C of FIG. 3C.

Shown in FIG. 2A is a partial side elevational view of the body 40 of the motorcycle exhaust assembly of FIG. 1A. FIG. 2B provides a cross-sectional view of the body 40 taken along line 2B-2B of FIG. 2A. The cross-sections of the body 40 and the exhaust end cap 30 shown in FIG. 1B match, and are substantially egg-shaped in accordance with one embodiment. Further, as shown in FIGS. 2A-C, an example logo detail 50 may be disposed on a recessed section 60 on the exterior of the body 40.

With reference to FIGS. 3A-3D, the removable, interchangeable exhaust end cap 30 has a frusto conical body shape and a substantially egg-shaped cross-section matching the cross-sections of the exhaust end mount 80, the body 40, and the inlet end cap 70. The exhaust end cap 30, exhaust end mount 80, and inlet end cap 70 are made of a hard rigid material such as, but not limited to, carbon fiber, steel, or titanium. The exhaust end cap 30 includes three recessed sections 100, 110, 120 offset in a triangular configuration, and a substantially central exhaust port 130 that aligns with the baffle 140. The recessed sections 100, 110, 120 include holes 150 that receive fasteners 160 (e.g., threaded fasteners such as bolts or screws) to removably connect the exhaust end cap 30 to the exhaust end mount 80.

In use, disengaging the fasteners 160 in the holes 150 allows easy removal of the exhaust end cap 30 from the exhaust end mount 80, making it convenient to replace and/or access exhaust components of the exhaust assembly 10. It is similarly easy to interchange the exhaust end cap 30 with a different exhaust end cap 30. The exhaust end cap 30 (or a different interchangeable exhaust end cap 30) is placed against the exhaust end mount 80, and the fasteners 160 are inserted through the holes 150 and engaged to fasten the exhaust end cap 30 to the exhaust end mount 80.

Moreover, in one embodiment, the configurable motorcycle exhaust assembly 10 further includes a system of multiple interchangeable exhaust end caps 30. In one implementation, the multiple interchangeable exhaust end caps 30 have a variety of colors. In another implementation, the multiple interchangeable exhaust end caps 30 have a variety of shapes and designs. And, in yet another implementation, the multiple interchangeable exhaust end caps 30 are made of a variety of materials, including steel, titanium, and carbon fiber.

Figure 4:
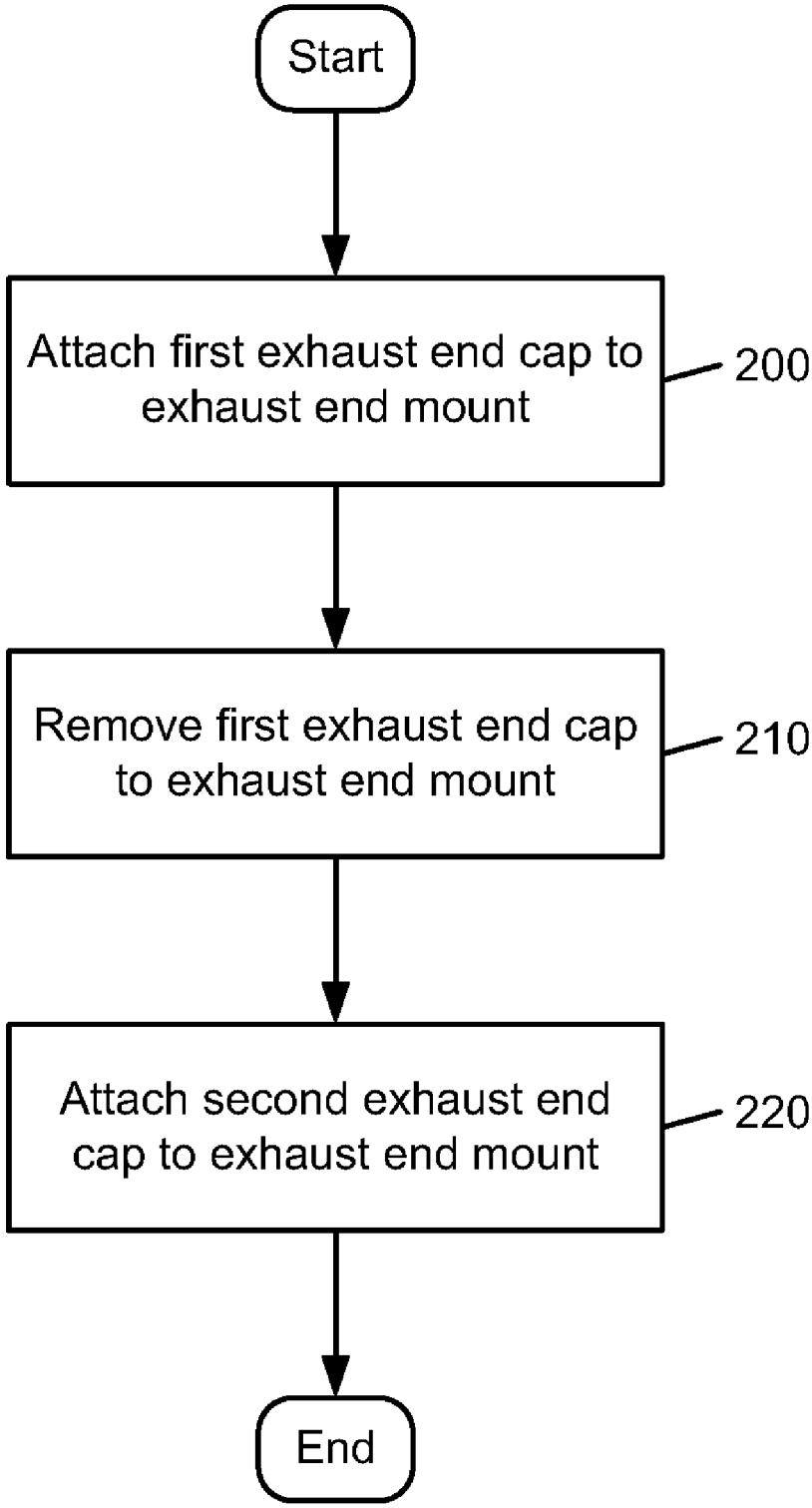
FIG. 4 is a flowchart illustrating a method of interchanging two exhaust end caps.

FIG. 4 is a flowchart illustrating an exemplary method of interchanging two exhaust end caps 30. As shown at step 200, a first exhaust end cap 30 is attached to the exhaust end mount 80 of an exhaust canister 20. As discussed above, in one example, attaching the first exhaust end cap 30 involves engaging fasteners 160 with the exhaust end mount 80 through holes 150. The first exhaust end cap 30 is removed from the exhaust end mount 80, at step 210. According to the current example, this is accomplished by disengaging the fasteners 160 connecting the exhaust end cap 30 to the exhaust end mount 80. At step 220, a second exhaust end cap 30 is attached to the exhaust end mount 80 of an exhaust canister 20, using fasteners 160 engaged through holes 150 to the exhaust end mount 80. A first exhaust end cap 30 is thus conveniently interchanged with a second exhaust end cap 30.

In one example, an embodiment of the foregoing method allows a motorcycle owner to easily keep pace with current trends in motorcycle styling. An owner can interchange an exhaust end cap 30 for another, different exhaust end cap and appreciate an enhanced visual appeal, as can other observers. An owner can also more effectively visually distinguish his or her motorcycle from other motorcycles by interchanging a removable exhaust end 30 with another. These benefits to the motorcycle owner inhere to the flexibility provided by using a removable, interchangeable exhaust end cap 30 to easily obtain a variety of attributes and qualities not otherwise available.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A configurable motorcycle exhaust assembly, comprising:

an elongated hollow body having a substantially egg-shaped cross-section;

an inlet end cap fixedly connected to an inlet end of the elongated hollow body and having a substantially egg-shaped cross-section;

an exhaust end mount fixedly connected to an exit end of the elongated hollow body and having a substantially egg-shaped cross-section; and a plurality of different exhaust end caps, each exhaust end cap removably attachable to the exhaust end mount, wherein each exhaust end cap has a frusto conical shape and a substantially egg-shaped cross-section, and the exhaust end cap includes a length and recessed sections with holes, the recessed sections extending substantially the entire length of the exhaust end cap and including an exposed periphery.

2. The configurable motorcycle exhaust assembly of claim 1, wherein the plurality of exhaust end caps includes exhaust end caps having a variety of colors.

3. The configurable motorcycle exhaust assembly of claim 1, wherein the plurality of exhaust end caps includes exhaust end caps having a variety of shapes.

4. The configurable motorcycle exhaust assembly of claim 1, wherein the plurality of exhaust end caps includes exhaust end caps made of variety of materials.

5. The configurable motorcycle exhaust assembly of claim 4, wherein the materials include at least one of steel, titanium, and carbon fiber.

* * * * *